US007195003B2

(12) United States Patent
Liskow

(10) Patent No.: US 7,195,003 B2
(45) Date of Patent: Mar. 27, 2007

(54) FUEL INJECTION SYSTEM

(75) Inventor: Uwe Liskow, Pleidelsheim (DE)

(73) Assignee: Robert Bosch GmbH, Stuttgart (DE)

( * ) Notice: Subject to any disclaimer, the term of this patent is extended or adjusted under 35 U.S.C. 154(b) by 380 days.

(21) Appl. No.: 10/169,963

(22) PCT Filed: Nov. 12, 2001

(86) PCT No.: PCT/DE01/04207

§ 371 (c)(1),
(2), (4) Date: Oct. 11, 2002

(87) PCT Pub. No.: WO02/38950

PCT Pub. Date: May 16, 2002

(65) Prior Publication Data

US 2005/0115546 A1 Jun. 2, 2005

(30) Foreign Application Priority Data

Nov. 11, 2000 (DE) ..... 100 56 038

(51) Int. Cl.
*F02M 37/04* (2006.01)

(52) U.S. Cl. ..... 123/470; 123/456

(58) Field of Classification Search ..... 123/470, 123/472, 456, 469, 468; 239/600
See application file for complete search history.

(56) References Cited

U.S. PATENT DOCUMENTS 4,693,223 A * 9/1987 Eshleman et al. ..... 123/468
4,984,548 A * 1/1991 Hudson, Jr. ..... 123/470
5,120,084 A 6/1992 Hashimoto
5,372,113 A 12/1994 Smith
5,551,400 A 9/1996 Rice et al.
6,062,200 A * 5/2000 Hofmeister ..... 123/470
6,102,007 A * 8/2000 Furst ..... 123/469
6,148,767 A * 11/2000 Manchess ..... 119/75
6,199,538 B1 * 3/2001 Aota et al. ..... 123/470
6,325,049 B1 * 12/2001 Nally ..... 123/470
6,374,806 B1 * 4/2002 Keeley et al. ..... 123/456
6,431,151 B1 * 8/2002 Gmelin ..... 123/470
6,481,646 B1 * 11/2002 Hornby ..... 239/585.1
6,701,899 B2 * 3/2004 Liskow ..... 123/470

FOREIGN PATENT DOCUMENTS

DE 197 25 076 12/1998
DE 198 32 077 1/2000
JP 08-312503 11/1996

* cited by examiner

*Primary Examiner*—Carl S. Miller
(74) *Attorney, Agent, or Firm*—Kenyon & Kenyon LLP

(57) ABSTRACT

In a fuel injection system including at least one fuel injector which includes an inflow section and a fuel distributor line which includes for each fuel injector a coupling connection, an annular gasket support is provided for a sealing connection of the inflow section with the coupling connection; this gasket support cooperates with a first sealing element for sealing the gasket support from an end face of the inflow section and includes a second sealing element for sealing the gasket support from the coupling connection. A guide section of the inflow section passes through the gasket support, and a retaining ring is provided on the inflow section secures the gasket support so that it is movable in the radial direction between the retaining ring and the end face.

11 Claims, 1 Drawing Sheet

FUEL INJECTION SYSTEM

FIELD OF THE INVENTION

The present invention relates to a fuel injection system for injecting fuel into an internal combustion engine, e.g., for direct injection of fuel into the combustion chamber(s) of the engine.

BACKGROUND INFORMATION

Such a fuel injection system is described in German Published Patent Application No. 197 25 076. For a sealing connection between a fuel injector and a respective coupling connection of a fuel distributor line, this injection system includes an annular gasket support which cooperates with a first sealing element for sealing off the gasket support from an end face of an inflow section of the fuel injector and includes a second sealing element for sealing off the gasket support from the coupling connection of the fuel distributor line. A bushing insertable into a fuel inlet opening of the inflow section passes through the annular gasket support, so that the gasket support is movably arrested in the radial direction between an upstream collar of the bushing and the inflow section of the fuel injector.

One disadvantage of the arrangement described in the publication cited above is that the bushing is an additional part which is manufactured with a low tolerance. The radial mobility of the gasket support is guaranteed only if it still has a certain axial play and is not pressed by the bushing against the inflow section, so the bushing is inserted to a precisely defined depth into the fuel inlet opening in assembly. This requires a precision finished cylindrical surface of the bushing and a bore produced with a corresponding fit as the fuel inlet opening in order to achieve a tight seating of the bushing, so that the required play for the gasket support is adjustable.

It is described in Unexamined Japanese Published Patent No. 08-312503 that a fuel injector insertable into a receiving bore and including an inflow section may be sealed by an O-ring on this inflow section with respect to a coupling connection of a fuel distributor line. The O-ring is in sealing contact with an inside wall of the coupling connection.

Due to the manufacturing tolerance of the receiving bore for the fuel injector as well as that of the coupling connection to the fuel distributor line, differences in position and angle occur between the inflow section of the fuel injector and the coupling connection of the fuel distributor. The O-ring situated between the inflow section of the fuel injector and the coupling connection of the fuel distributor line equalizes the differences in position and angle only to a very slight extent, which is inadequate. With regard to the differences in position and angle occurring in practice, in the case of the fuel injector system described in Unexamined Japanese Published Patent No. 08-312503, there is a risk of fuel escaping past the seal, which does not adequately compensate for the position and angle differences.

SUMMARY OF THE INVENTION

The fuel injection system according to the present invention may provide the advantage that the O-rings used for sealing need not compensate for the position and angle differences through a purely elastic deformation. The O-rings are not deformed on one side. The fuel injection system according to the present invention may provide the advantage that additional components in the form of bushings which requires precision manufacturing are eliminated. In addition, the fuel injector need not include an inflow bore finished to fit. Therefore, the manufacturing complexity of these parts may be reduced and thus the manufacturing costs lowered accordingly.

It may be advantageous if the first sealing element is guided in a first ring groove in a downstream, radially aligned end face of the gasket support and is slidingly movable in the radial direction on the end face of the inflow section of the fuel injector.

It may be advantageous if the first sealing element is guided in a first ring groove in the end face of the inflow section of the fuel injector and is slidingly movable in the radial direction on a downstream end face of the gasket support which is aligned radially. The shape of the sealing element is thereby simplified. The additional ring groove in the end face of the inflow section of the fuel injector is less expensive to manufacture by comparison because precision machining by lathing the parts of the fuel injectors is required in any case.

It may be advantageous if an upper and/or lower supporting ring having a larger outside diameter than the gasket support is provided downstream from the second sealing element in the second ring groove and is freely movable radially. Thereby, excess deformation of the O-ring and resulting leakage of the fuel injection system may be prevented.

Advantageously the retaining ring may be weldable to the inflow section or held in a groove of the inflow section in a simple manner. Manufacturing complexity is greatly reduced when the retaining ring is guided in a groove, because care must be taken to ensure the position of this ring groove only in manufacturing the parts of the fuel injector, which in any case is done with a low tolerance.

Example embodiments of the present invention are shown in simplified form in the drawings and explained in greater detail in the following description.

DETAILED DESCRIPTION

Figure 1:
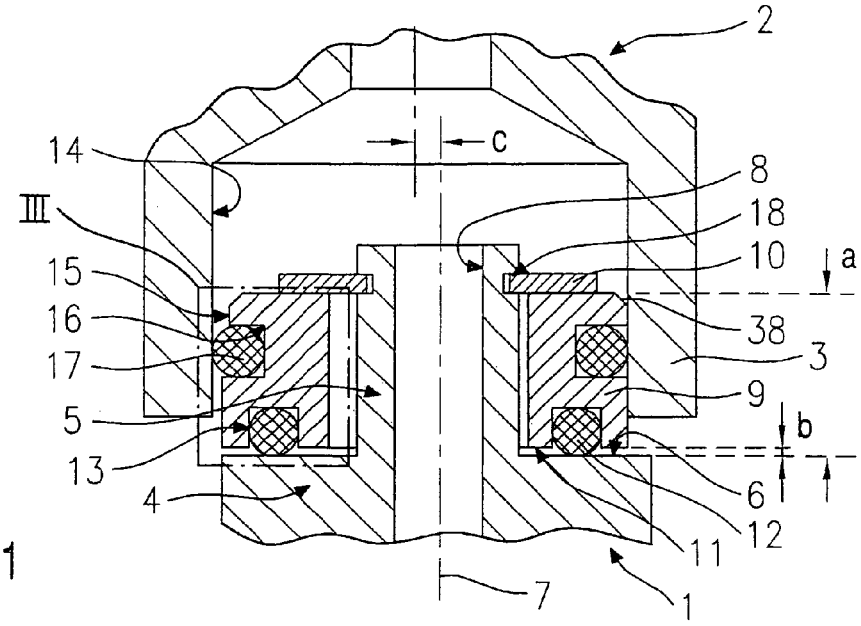
FIG. 1 shows a section through an example embodiment according to the present invention in a detail of a diagram of the connecting area between the fuel injector and the fuel distributor line.

FIG. 1 shows an example embodiment of the present invention in a detail of a sectional diagram. Only the coupling connection area between a fuel injector 1 and a fuel distributor line 2 is shown. Fuel distributor line 2 is shown here only in the area of a coupling connection 3.

Fuel injector 1 includes an inflow section 4 including a guide section 5 which is configured in one piece with inflow section 4 of fuel injector 1. An end face 6 is configured on inflow section 4 at a transition to guide section 5. Along a central axis 7 of fuel injector 1, an inflow bore 8 for fuel passes through guide section 5 and inflow section 4. A gasket support 9 includes a guide section 5 passing through it and is locked between inflow-side end face 6 of inflow section 4 and a retaining ring 10 situated on the inflow end of guide section 5 and projecting radially outward. Retaining ring 10 is situated on guide section 5 of fuel injector 1 with an axial distance a from end face 6, shown here for the sake of illustration so that gasket support 9 is axially movable with a play b to a slight extent. Gasket support 9 is thus not clamped between retaining ring 10 of guide section 5 and inflow section 4 of fuel injector 1 but instead is radially movable within a displacement area c, which is also shown for the sake of illustration, in the radial direction.

Gasket support 9 includes a radially aligned end face 11 opposite end face 6 of inflow section 4 of fuel injector 1 on its downstream end. A first peripheral ring groove 12 is provided on gasket support 9 and is used to accommodate and guide a first sealing element 13 in the form of a sealing ring configured as an O-ring. First sealing element 13 functions as an axial seal and seals off gasket support 9 from inflow section 4 of fuel injector 1. First sealing element 13 is slidingly movable on end face 11 of inflow section 4 of fuel injector 1.

Furthermore, gasket support 9 includes a second ring groove 16 on a lateral surface 15 opposite a wall 14 of coupling connection 3. Second ring groove 16 is used to accommodate and guide a second sealing element 17 in the form of a sealing ring configured as an O-ring. Second sealing element 17 produces a radial seal and seals off gasket support 9 from coupling connection 3. Second sealing element 17 is slidingly displaceable in coupling connection 3.

In an example embodiment, retaining ring 10 is inserted into a ring groove 18 in guide section 5 of inflow section 4 of fuel injector 1. Retaining ring 10, when configured as an open ring, may be installed easily by being spread by a suitable tool and pushed over guide section 8. Due to the internal stress of retaining ring 10, it is held in ring groove 18. When gasket support 9 is acted upon by fuel pressure in operation, the entire upstream end face 6 of gasket support 9 up to its outside diameter is thus available on the upstream side as a working surface for fuel pressure. However, gasket support 9 is exposed to the fuel pressure on its downstream end at the most up to first sealing element 13 because the area further toward the outside radially is sealed. Gasket support 9 is therefore acted upon by an effective axial force component through the fuel pressure, pressing gasket support 9 in the direction of fuel injector 1. First sealing element 13 is therefore pressed against end face 6 of inflow section 4 of fuel injector 1, resulting in a good sealing effect.

Annular gasket support 9 may advantageously permit a radial equalization as well as an axial equalization between the position of inflow section 4 of fuel injector 1 and the position of coupling connection 3. This inexpensive, easy-to-manufacture configuration of the components may be advantageous. Inflow section 4 of fuel injector 1 is manufactured to a high precision, like all parts of fuel injector 1, and may be machined by lathing. The configuration of a guide section 5 including a ring groove 18 cut in it constitutes an increased expense, although it is almost insignificant. Only a single size, namely the distance a between ring groove 18 and end face 6, need be maintained with precision. This permits great cost savings in comparison with an additional component and a bore to be made to fit.

Figure 2:
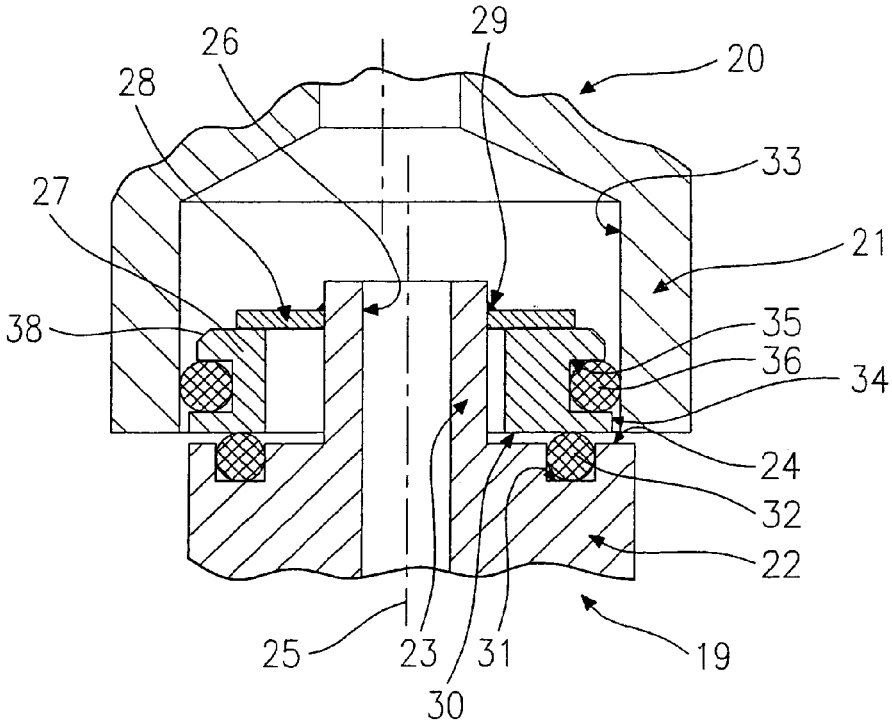
FIG. 2 shows a section through another example embodiment according to the present invention in a detail of a diagram of the connecting area between the fuel injector and the fuel distributor line.

FIG. 2 shows another example embodiment of a fuel injection system according to the present invention in a detail of a cut-away diagram. As in FIG. 1, the connection area between a fuel injector 19 and a fuel distributor line 20, of which only a coupling connection 21 is visible here, is shown. Fuel injector 19 includes an inflow section 22 which is configured in one piece with a guide section 23.

An end face 24 is configured on inflow section 22 at the transition to a guide section 23. An inflow bore 26 for fuel passes through guide section 23 and inflow section 22 along a central axis 25 of fuel injector 19. A gasket support 27 includes guide section 23 passing through it and is locked between inflow-side end face 24 of inflow section 22 and a retaining ring 26 which projects radially outward and is situated on the inflow end of guide section 23. Retaining ring 28 is connected by peripheral weld 29 to guide section 23 in the example embodiment shown here as an example.

Gasket support 27 is not clamped between retaining ring 28 of guide section 23 and inflow section 22 of fuel injector 19 due to the arrangement of retaining ring 28 according to FIG. 1, but instead is movable in the radial direction. On its downstream end, gasket support 27 includes a radially aligned end face 30 opposite end face 24 of inflow section 22 of fuel injector 19.

A first peripheral ring groove 31 is configured in end face 24 of inflow section 22 to receive and guide a first sealing element 32 in the form of an O-ring. First sealing element 32 seals the gasket support 27 in a slidingly movable manner from inflow section 22 of fuel injector 19.

In addition, gasket support 27 includes a second ring groove 35 on a lateral face 34 opposite a wall 33 of coupling connection 21. A second sealing element 36 in the form of an O-ring is guided in second ring groove 35. Slidingly movable second sealing element 36 radially seals off gasket support 27 from coupling connection 21.

It may be advantageous in this example embodiment that gasket support 27 is further simplified in that first ring groove 31 is situated in end face 24 of fuel injector 19. First ring groove 31 is produced on fuel injector 19 more easily and less expensively. Functioning is in no manner impaired by the fact that first sealing element 32 is not positioned in end face 30 of gasket support 27 but instead in end face 24 of inflow section 22 of fuel injector 19.

Figure 3:
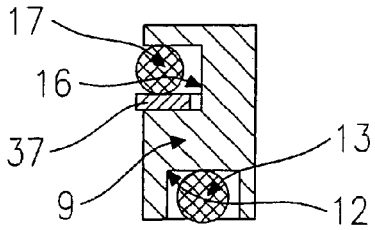
FIG. 3 shows another example embodiment of a fuel injection system according to the present invention in a detail corresponding to detail III of FIG. 1.

FIG. 3 shows another example embodiment of a fuel injection system according to the present invention in a detail according to detail III in FIG. 1. This example embodiment differs from fuel injector 1 in FIG. 1 only in this detail. Therefore, the same reference numbers are used for the same parts.

Gasket support 9 is shown in a sectional diagram, illustrating first ring groove 12 including first sealing element 13. Second sealing element 17 is guided in second ring groove 16. In an example embodiment, a supporting 37 is situated downstream from second sealing element 17, which is configured as an O-ring. The inside diameter of supporting ring 37 is such that it does not extend to the bottom of second ring groove 16 and consequently it is radially movable.

Due to this configuration, the outside diameter of gasket support 9 may have a smaller dimension, and sealing element 17 may be exposed to greater tilting angles without undergoing inadmissible deformation.

An upper supporting ring including a larger outside diameter than gasket support 9 is provided upstream from second sealing element 17 and is guided in second ring groove 16 and with free radial mobility. Gasket support 9 includes a conical radial chamfer on its upstream end.

What is claimed is:

1. A fuel injection system for injecting a fuel into an internal combustion engine, comprising:

at least one fuel injector that includes an inflow section;

a fuel distributor line that includes, for the at least one fuel injector, a coupling connection connectable to the inflow section;

an annular gasket support for providing a sealing connection of the inflow section to the coupling connection;

a first sealing element that cooperates with the annular gasket support to seal off the annular gasket support from an end face of the inflow section;

a second sealing element for sealing off the annular gasket support from the coupling connection;

a guide section, which is included in the inflow section and, starting out from the end face of the inflow section, completely passes through the annular gasket support as part of the inflow section;

wherein the first sealing element is guided in a first ring groove in the end face of the inflow section and is slidingly movable in the radial direction on a downstream, radially oriented end face of the annular gasket support.

2. A fuel injection system for injecting a fuel into an internal combustion engine, comprising:

at least one fuel injector that includes an inflow section;

a fuel distributor line that includes, for the at least one fuel injector, a coupling connection connectable to the inflow section;

an annular gasket support for providing a sealing connection of the inflow section to the coupling connection;

a first sealing element that cooperates with the annular gasket support to seal off the annular gasket support from an end face of the inflow section;

a second sealing element for sealing off the annular gasket support from the coupling connection;

a guide section included in the inflow section and passing through the annular gasket support; and a retaining ring included on the inflow section upstream from the annular gasket support so that the annular gasket support is secured movably in a radial direction between the retaining ring and the end face of the inflow section, wherein:

the retaining ring is a separate component part and is fixed directly to a peripheral surface of the inflow section.

3. The fuel injection system according to claim 1, further comprising:

a retaining ring included on the inflow section upstream from the annular gasket support so that the annular gasket support is secured movably in a radial direction between the retaining ring and the end face of the inflow section.

4. The fuel injection system according to claim 2, wherein:

a gap remains between the end face of the inflow section and the end face of the annular gasket support due to an arrangement of the retaining ring and an elasticity of the first sealing element even when acted upon by the fuel under pressure.

5. The fuel injection system according to claim 2, wherein:

the second sealing element is guided in a second ring groove of an axially oriented lateral surface of the annular gasket support and is slidingly movable in an axial direction on a wall of the coupling connection.

6. The fuel injection system according to claim 2, further comprising:

a lower supporting ring arranged downstream from the second sealing element and having a larger outside diameter than the annular gasket support, the lower supporting ring being guided in a radially freely movable manner in the second ring groove.

7. The fuel injection system according to claim 2, further comprising:

an upper supporting ring having a larger outside diameter than the annular gasket support, the upper supporting ring being guided in a radially freely movable manner in the second ring groove upstream from the second sealing element.

8. The fuel injection system according to claim 2, wherein:

the annular gasket support includes a conical radial chamfer arranged on a periphery of an upstream end of the annular gasket support.

9. The fuel injection system according to claim 2, wherein:

the retaining ring is welded to the inflow section.

10. The fuel injection system according to claim 2, wherein:

the retaining ring is held in a groove of the inflow section.

11. The fuel injection system according to claim 2, wherein:

the first sealing element and the second sealing element are configured as peripheral ring seals.

* * * * *